US005213270A

United States Patent [19]

Stouffer et al.

[11] Patent Number: 5,213,270

[45] Date of Patent: May 25, 1993

[54] LOW COST, LOW PRESSURE FLUIDIC OSCILLATOR WHICH IS FREE OF FEEDBACK

[75] Inventors: Ronald D. Stouffer, Silver Spring; Dharapuram Srinath, Hanover, both of Md.

[73] Assignee: Bowles Fluidics Corporation

[21] Appl. No.: 759,557

[22] Filed: Sep. 13, 1991

[51] Int. Cl.[5] ..... B05B 1/08

[52] U.S. Cl. ..... 239/589.1; 137/811; 239/DIG. 3

[58] Field of Search ..... 239/11, 589.1, 590, 239/DIG. 3; 137/811, 833, 839, 810, 825, 826, 808, 809

[56] References Cited

U.S. PATENT DOCUMENTS

| | | | |
|---|---|---|---|
| 4,151,955 | 5/1979 | Stouffer | 239/589.1 |
| 4,398,664 | 8/1983 | Stouffer | 239/589.1 |
| 4,508,267 | 4/1985 | Stouffer | 239/11 |
| 4,562,867 | 1/1986 | Stouffer | 137/811 |
| 4,596,364 | 6/1986 | Bauer | 239/590 |
| 4,662,568 | 5/1987 | Bauer | 239/590.5 |
| 4,721,251 | 1/1988 | Kondo et al. | 239/589.1 |
| 5,035,361 | 7/1991 | Stouffer | 137/826 |

*Primary Examiner*—Kevin P. Shaver
*Assistant Examiner*—Christopher G. Trainor
*Attorney, Agent, or Firm*—Jim Zegeer

[57] ABSTRACT

A fluidic oscillator which is free of feedback passages has an oscillation chamber having a length greater than its width, a pair of mutually facing and complementarily-shaped sidewalls and planar top and bottom walls, and first and second end walls. An input power nozzle is formed in said first end wall having a width W and a depth D, for issuing a stream of fluid into the oscillation chamber, and form alternately pulsating, cavitation-free vortices in said oscillation chamber on each side of the stream. An outlet opening formed in the downstream end wall and axially aligned with the power nozzle and has a width and depth such that internal pressure in the oscillation chamber is greater than ambient. The outlet wall is hingedly connected to a chamber wall and the chamber is such that it can be molded with the outlet wall hingedly connected thereto in one molding.

8 Claims, 3 Drawing Sheets

LOW COST, LOW PRESSURE FLUIDIC OSCILLATOR WHICH IS FREE OF FEEDBACK

BACKGROUND AND BRIEF DESCRIPTION OF THE INVENTION

There are a large number of fluidic oscillators useful for issuing a sweeping fluid stream into ambient. See, for example, Stouffer U.S. Pat. Nos. 4,652,002, 4,508,267, Bray U.S. Pat. Nos. 4,463,904, 4,645,126, Turner U.S. Pat. No. 3,432,102, Walker U.S. Pat. No. 3,507,275, Viets U.S. Pat. No. 3,998,386, Stouffer et al. U.S. Pat. No. RE 33,158, Bauer U.S. Pat. No. 4,157,167, Stouffer U.S. Pat. No. 4,151,155, and Bauer U.S. Pat. No. 4,184,636 are free of feedback channels: Stouffer '155 depends on vortices alternately shed from an island and Bauer '636 uses a reversing chamber feeding a separate output chamber. While Stouffer '155 can be molded in a single molding so that it does not require assembly, its frequency of oscillation is high. In a previous oscillating device called a "Travetron", alternating vortices were formed but these were high pressure devices and the vortices cavitated and the oscillation chamber was wider than it was long. U.S. Pat. No. 4,721,251 discloses a fluidic oscillator having walls defining first and second chambers with the second chamber being stepwise widened from the first chamber and having a "turn" wall for turning the branch flow therein to collide with a deflected main jet to push the main jet in an opposite direction. The laterally spaced sidewalls of the first chamber serve as sucking and deflecting walls. The second chamber and its laterally displaced sidewalls make the unit wider than its length.

The object of the present invention is to provide an improved fluidic oscillating nozzle for dispersal or distribution of fluid, and more particularly, to a single feedback-free oscillator which operates a low pressure and which can be made at lower cost, preferably in a single molding and does not require expensive assembly equipment and which eliminates problems from sealing. The unit is simpler than prior art designs and has a good fan angle.

SUMMARY OF THE INVENTION

According to this invention, a low pressure, feedback passage, free fluidic oscillating nozzle has a substantially oscillation chamber having a length L which is greater than its width W, with a pair of mutually facing sidewalls. An input power nozzle has a width PW and a depth D and issues fluid into the oscillation chamber. The downstream side of the oscillation chamber has an outlet formed therein which pressures within the chamber is always positive relative to ambient. A pair of short walls diverge from the outlet opening in a downstream direction. A feature of the invention is that a pair of alternating pulsating, cavitation-free vortices are formed in the chamber on each side of the fluid stream flowing through the chamber and centers thereof are translated as they grow.

Fluidic oscillating nozzles of the present invention are particularly adapted for the dispersion of fluids into the atmosphere.

DETAILED DESCRIPTION OF THE DRAWINGS

Figure 1A:
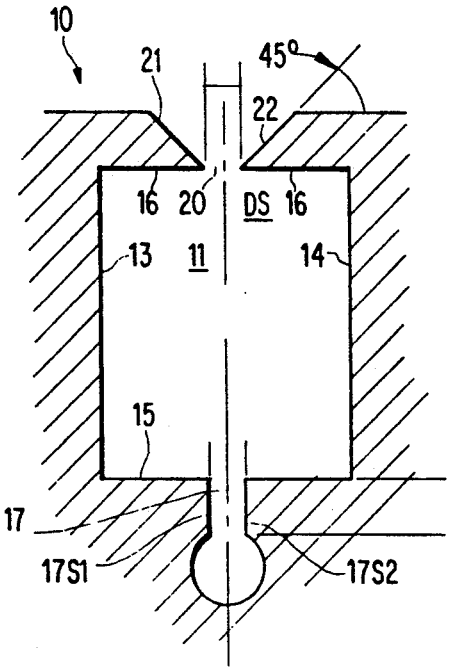
Figure 1B:
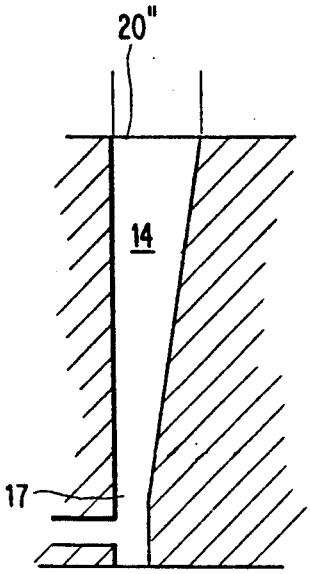
Figure 8:
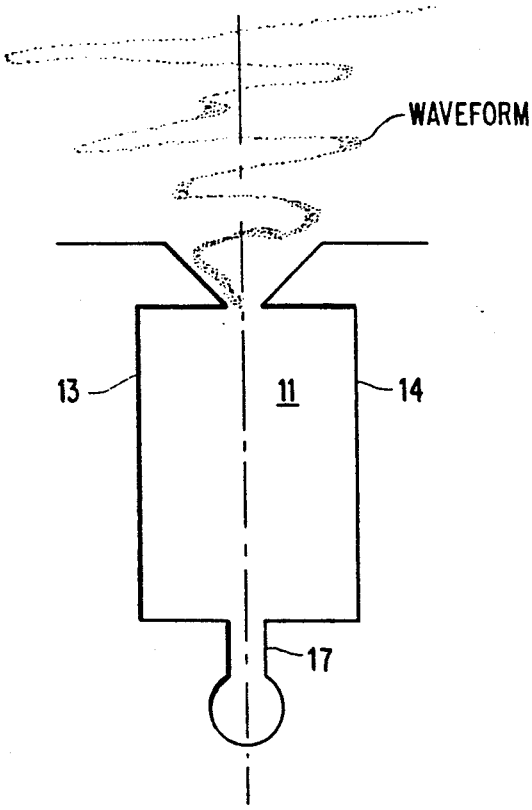
Figure 9:
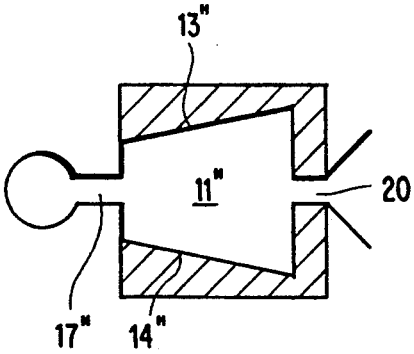
Figure 10A:
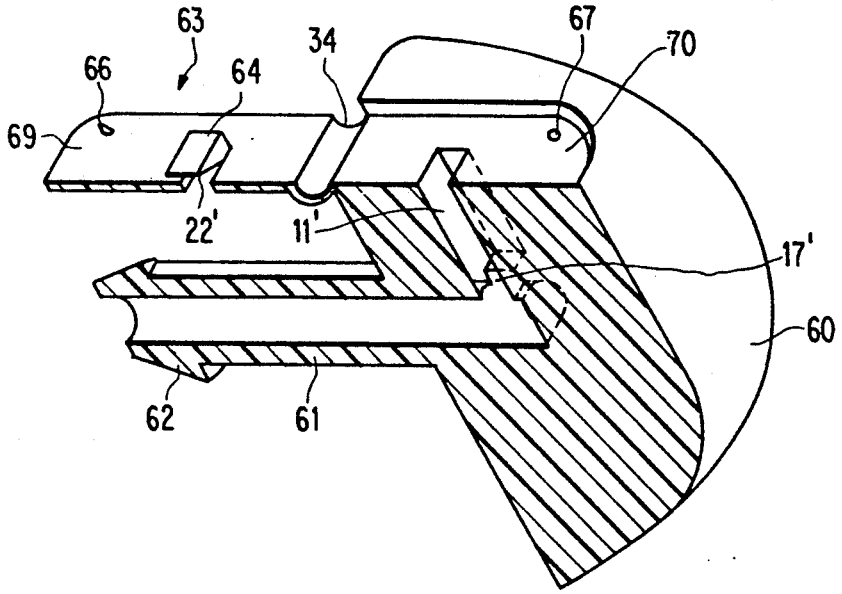
Figure 10B:
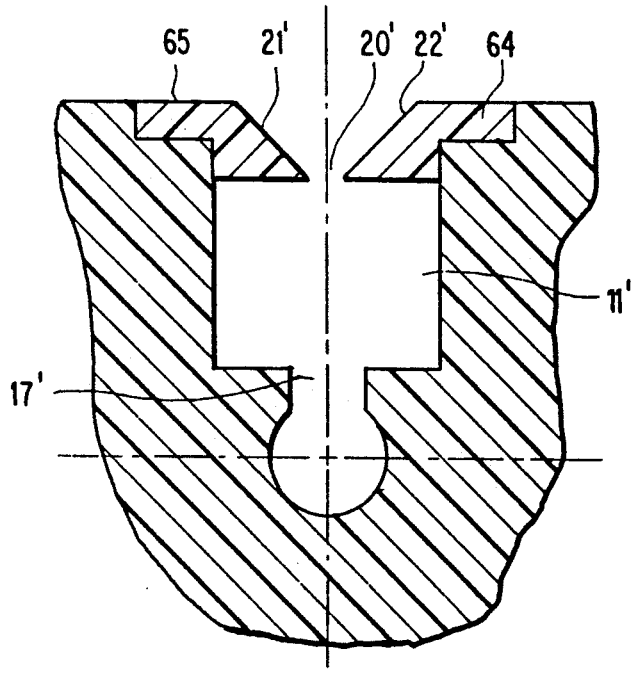

The above and other objects, advantages and features of the invention will become more apparent when considered with the following specification and accompanying drawings wherein:

FIG. 1*a* is a plan view of a silhouette of an oscillating fluidic nozzle incorporating the invention, the dimensions given are exemplary, FIG. 1*b* illustrates a taper that may be incorporated similar to that in Bray patents referred to above, FIGS. 2–7 are diagrammatic illustrations of sequential states of the operative vortices within the oscillation chamber, FIG. 8 illustrates output characteristics, FIG. 9 is a plan view of a modification of the invention, FIG. 10*a* is an isometric sectional view illustrating the hinged connection of the wall forming the outlet structure to the oscillation chamber housing for single piece molding, and FIG. 10*b* is a sectional view with the outlet end snapped in place.

DETAILED DESCRIPTION OF THE INVENTION

Referring specifically to the embodiment of FIG. 1, an oscillator 10 is comprised of a generally rectangular chamber 11, the shape of which is such that a mold core element (not shown) can be withdrawn through the downstream end DS. Chamber 11 is formed of a pair of complementary-shaped sidewalls 13, 14, an input upstream wall or end 15, and an output downstream wall or end 16. The length of walls 13 and 14 is greater than the maximum width of the chamber 11. A power nozzle 17 formed in upstream end 16 is supplied with fluid from a supply (such as a supply of a washing liquid under pressure to be dispersed or sprayed to ambient). In this embodiment, the sidewalls 17S, $17S_2$ of the power nozzle 17 are parallel, but they could diverge slightly and be curved. Sidewalls 13 and 14 are parallel in this embodiment and chamber 11 is substantially rectangular. In a preferred embodiment, the length is about 8 W long and the width is about 5 W wide (ratio of about 1.6).

An outlet opening 20 is coaxial with the power nozzle 17 and has a width and depth such that internal pressure in the chamber is greater than ambient so as to preclude ingestion of ambient fluids such as air. This also assists in assuring that the pair of operative vortices formed in the chamber are cavitation-free. Moreover, the width of the outlet opening is such that in start-up operation, a portion of the edges of the jet or stream issuing through power nozzle 17 is scooped-off at both sides of the jet to initiate the "start-up" operation shown in FIGS. 2–4. Outlet 20 has a pair of short diverging walls 21, 22.

Figure 2:
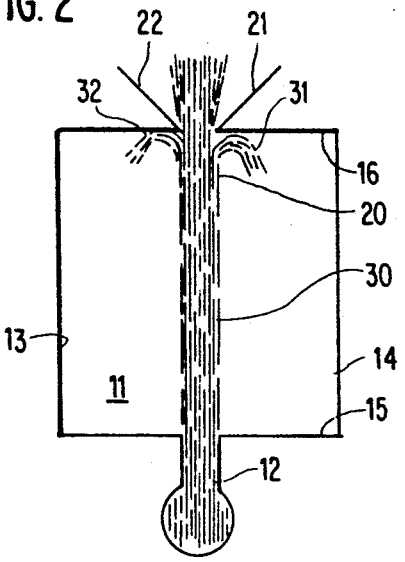
Figure 3:
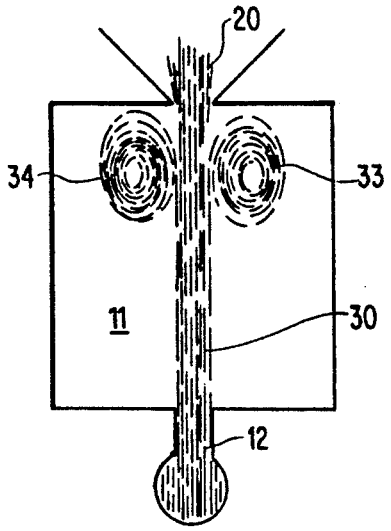
Figure 4:
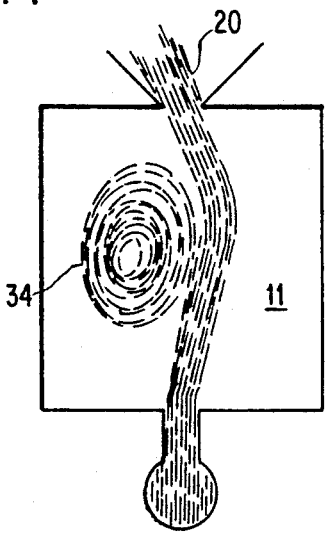

Referring now to FIGS. 2–4, a jet or stream 30 of fluid such as a windshield wash liquid for automobile windshields, or propane fuel for a torch, having an oscillating nozzle thereon, etc., is projected at relatively low pressure (down to about one psi where a flow of 560 ML per minute at 9 psi is desired in a specific application).

The portions 31, 32 scooped-off of each side by the edges form vortices 33, 34, which grow or enlarge in the chamber halves defined by the power stream or jet 30. At this state, the main power stream exits outlet 20 in a straight or undeflected line. Because of some minor pertuberance in the chamber or power stream, one of vortices 33 or 34 will grow stronger and become dominant and, as shown in FIG. 4, vortex 34 has become dominant (because vortice 33 is not dominant, it is not shown in FIG. 4 as it has started to dissipate and move out of the chamber) and is pushing or deflecting the jet 30 to the right causing the main jet 30 to exit through outlet 20 to the left.

Figure 5:
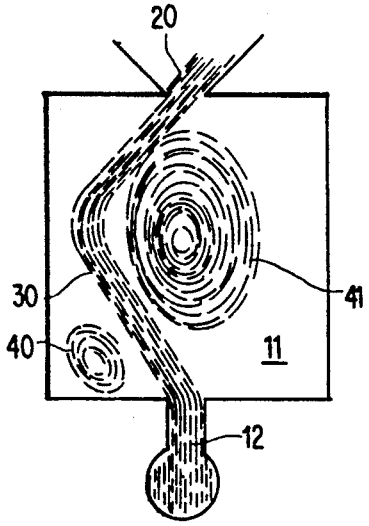
Figure 6:
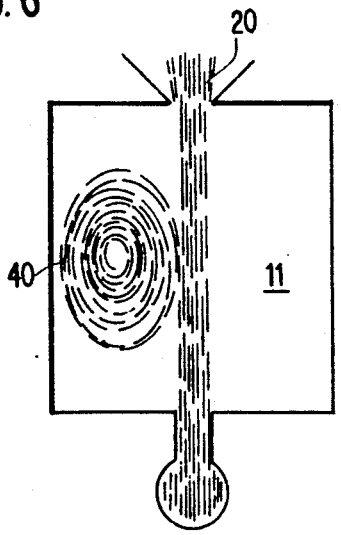
Figure 7:
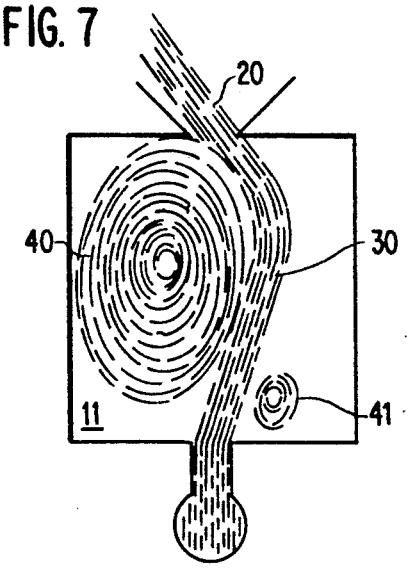

FIGS. 5–7 illustrate one full oscillation operation or sequence following the start-up shown in FIGS. 2–4. Referring to FIG. 5, the jet 30 is shown pushed or deflected to the left (with the jet issuing to the right) and a small strong circulation vortex 40 is formed in the lower right-hand corner. This vortex is formed differently than the start-up vortices 33, 34, and it grows or expands by drawing fluid from jet 30. The large weak vortex 41 is beginning to be dissolved or dissipated while in the left half of chamber 11, vortex 40 grows and the center thereof translates in a downstream direction to where the vortex begins to act to deflect or bend the jet 30 to the right. As shown in FIG. 6, the large weak circulation of vortex 41 dissolves into the main jet 30 and moves out of the unit through output opening 20. Finally, after the jet 30 is fully deflected to the right, with the jet exiting to the left, vortex 40 has grown to its maximum expansion and a new vortex 41 forms in the lower right-hand corner and the process repeats itself.

The output characteristics are illustrated in FIG. 8. The waveform 50 is shown as having jagged edges, but is uniform in fluid distribution. The jagged edges of the waveform in this illustration result from random aperiodicity of jet travel.

Referring now to FIG. 9, a trapezoidal chamber 11' is illustrated with the downstream end slightly wider than the upstream end. This permits any mold core part to be withdrawn in a one-piece molding operation.

In FIG. 10, the outlet end of the chamber is illustrated as hinged by integral molded hinge 50. In this unit, the outlet wall 16 is adapted to snap into and seal socket 51 formed in the downstream end of the oscillation chamber.

A sectional view through a single molding of the embodiment shown in FIG. 1 is illustrated in FIG. 10*a*, with the downstream wall hingedly coupled to the main body portion. FIG. 10*b* shows a sectional view with the downstream wall snapped in place. The main body 60 shows half of the oscillation chamber 11' and half of the power nozzle 17'. Input nipple or barb 61 is adapted to retain a flexible hose (not shown) by retention rib 62 and provide a supply of fluid under pressure to the power nozzle. The outlet end 63 is connected by hinge 34 to the main body portion 60. Outlet end 63 has a pair of protruding segments 64, 65 which fit snugly in the downstream end of chamber 11' and thereby form a tight seal and constraining fluid flow through outlet aperture 10' formed between members 64 and 65. Molded detent members 66 are received in detent cavities 67 to latch the outlet end to the main body member 60 and the abutting faces 69 on outlet members 63 and 70 on the member 60 surrounding or bounding the end of chamber 11' to form a second seal area and prevent leaking.

In FIG. 1*b*, the top 55 and bottom 56 walls are at an angle to each other in the manner shown in the aforementioned Bray patents.

While preferred embodiments of the invention have been shown and described herein, it will be appreciated that various adaptations, modifications, and other embodiments will be apparent to those skilled in the art.

What is claimed is:

1. A low pressure fluidic oscillator which is free of feedback passages, comprising:

an oscillation chamber having an obstruction free length greater than its width, and being defined by a pair of mutually facing and complementarily-shaped sidewalls, top and bottom walls, and first and second end walls, means forming an input power nozzle in said first end wall having a width W and a depth D, for issuing a stream of fluid into said oscillation chamber, and form alternately pulsating, cavitation-free vortices in said oscillation chamber on each side of said stream, an outlet opening formed in said second end wall and axially aligned with said power nozzle and having a width and depth such that internal pressure in said chamber is greater than ambient, and a pair of short sidewalls diverging in a downstream direction from said outlet opening.

2. The fluidic oscillator defined in claim 1 wherein one of said top and bottom walls diverge from the other from said power nozzle through said outlet opening.

3. The fluidic oscillator defined in claim 1 wherein the ratio of length-to-width of said oscillation chamber is about 1.6.

4. The fluidic oscillator defined in claim 1 wherein said complementary-shaped sidewalls are straight.

5. The fluidic oscillator defined in claim 1 wherein said complementary-shaped sidewalls are straight and diverge from each other in the direction of said outlet opening.

6. The fluidic oscillator defined in any one of claims 1 through claim 5 wherein said oscillator is molded in a single piece.

7. The fluidic oscillator defined in any one of claims 1 through claim 5 wherein said oscillator is molded in a single piece, and wherein said top wall, bottom wall and sidewalls have upstream and downstream ends and said second end wall is hingedly connected to one of said downstream ends, and means forming a friction fit at the downstream end of said chamber for receiving said hingedly connected second end wall.

8. A molded one-piece fluidic oscillator which is free of feedback passages, comprising:

an oscillation chamber having an obstruction-free length greater than its width, a pair of mutually facing and complementarily-shaped sidewalls, top and bottom walls, and first and second end walls, said sidewalls and said top and bottom walls having upstream and downstream ends, means forming an input power nozzle in said first end wall having a width W and a depth D, for issuing a stream of fluid into said oscillation chamber, and form alternately pulsating, cavitation-free vortices in said oscillation chamber, said vortices being on each side of said stream, respectively, and being translated from where they are formed in the direction of flow of said stream of fluid, an outlet opening formed in said second end wall and axially aligned with said power nozzle, said outlet opening having a width and depth such that internal pressure in said chamber is greater than ambient, said oscillation chamber being obstruction free between said input power nozzle and said outlet opening, and said second end wall having an integral hinge connecting said second end wall to one of said downstream ends.

* * * * *